US007645083B2

(12) United States Patent
Burry et al.

(10) Patent No.: US 7,645,083 B2
(45) Date of Patent: Jan. 12, 2010

(54) MECHANICAL PENCIL

(75) Inventors: James M. Burry, Troutman, NC (US); Daniel R. Seymour, Mooresville, NC (US); Robert E. Irelan, Austin, TX (US); Dean A. Snyder, Austin, TX (US)

(73) Assignee: BISS Product Development LLC, Mooresville, NC (US)

( * ) Notice: Subject to any disclaimer, the term of this patent is extended or adjusted under 35 U.S.C. 154(b) by 705 days.

(21) Appl. No.: 11/314,783

(22) Filed: Dec. 21, 2005

(65) Prior Publication Data

US 2007/0025800 A1 Feb. 1, 2007

Related U.S. Application Data

(60) Provisional application No. 60/702,388, filed on Jul. 26, 2005.

(51) Int. Cl.
*B43K 21/22* (2006.01)

(52) U.S. Cl. ..... 401/93; 401/94; 401/92; 401/55

(58) Field of Classification Search ..... 401/55, 401/65–67, 86, 92–94, 88
See application file for complete search history.

(56) References Cited

U.S. PATENT DOCUMENTS

| | | | | | |
|---|---|---|---|---|---|
| 253,803 | A | | 2/1882 | Wittmann | |
| 2,032,983 | A | | 3/1936 | Hackney | |
| 2,261,314 | A | * | 11/1941 | Vogel | 401/93 |
| 2,509,849 | A | * | 5/1950 | Von Allmen Fritz | 401/67 |
| 2,801,613 | A | | 8/1957 | Gigli | |
| 4,362,410 | A | | 12/1982 | Hashimoto | |
| 4,856,693 | A | * | 8/1989 | Kageyama et al. | 226/127 |
| 5,044,805 | A | * | 9/1991 | Kosteniuk et al. | 401/82 |
| 5,362,166 | A | * | 11/1994 | Yamamoto et al. | 401/93 |
| 5,598,604 | A | * | 2/1997 | Ho | 15/433 |
| 6,793,429 | B2 | * | 9/2004 | Arrison | 401/93 |
| 2004/0047669 | A1 | * | 3/2004 | Lo | 401/92 |

* cited by examiner

*Primary Examiner*—David J Walczak
*Assistant Examiner*—Keegan Gumbs
(74) *Attorney, Agent, or Firm*—Hammer & Associates, P.C.

(57) ABSTRACT

The instant invention is a mechanical pencil. The pencil includes a body having a cavity and a lead holding mechanism located in the cavity. The lead holding mechanism includes a pair of arms joined together by a bridge. Each arm terminates with a pair of fingers. The fingers close together when the lead holding mechanism is recessed into the cavity. The fingers open when the lead holding mechanism is advanced out of the cavity.

12 Claims, 4 Drawing Sheets

30
40
42
44
32
38
36
46
48
22
50

MECHANICAL PENCIL

RELATED APPLICATION

This application claims the benefit of co-pending U.S. provisional patent application Ser. No. 60/702,388 filed Jul. 26, 2005.

FIELD OF THE INVENTION

The present invention is directed to a mechanical pencil.

BACKGROUND OF THE INVENTION

Mechanical pencils are known. See, for example, U.S. Pat. Nos. 253,803; 2,032,983; 2,509,849; 2,801,613; 4,856,693; 5,044,805; 5,362,166; 5,598,604; 6,793,429; and U.S. Publication No. 2004/0047669. These mechanical pencils are, however, complex and difficult to assemble.

There is a need for a mechanical pencil that is easily assembled and has few components.

SUMMARY OF THE INVENTION

The instant invention is a mechanical pencil. The pencil includes a body having a cavity and a lead holding mechanism located in the cavity. The lead holding mechanism includes a pair of arms joined together by a bridge. Each arm terminates with a pair of fingers. The fingers close together when the lead holding mechanism is recessed into the cavity. The fingers open when the lead holding mechanism is advanced out of the cavity.

DESCRIPTION OF THE DRAWINGS

For the purpose of illustrating the invention, there is shown in the drawings a form that is presently preferred; it being understood, however, that this invention is not limited to the precise arrangements and instrumentalities shown.

DETAILED DESCRIPTION OF THE INVENTION

Figure 1:
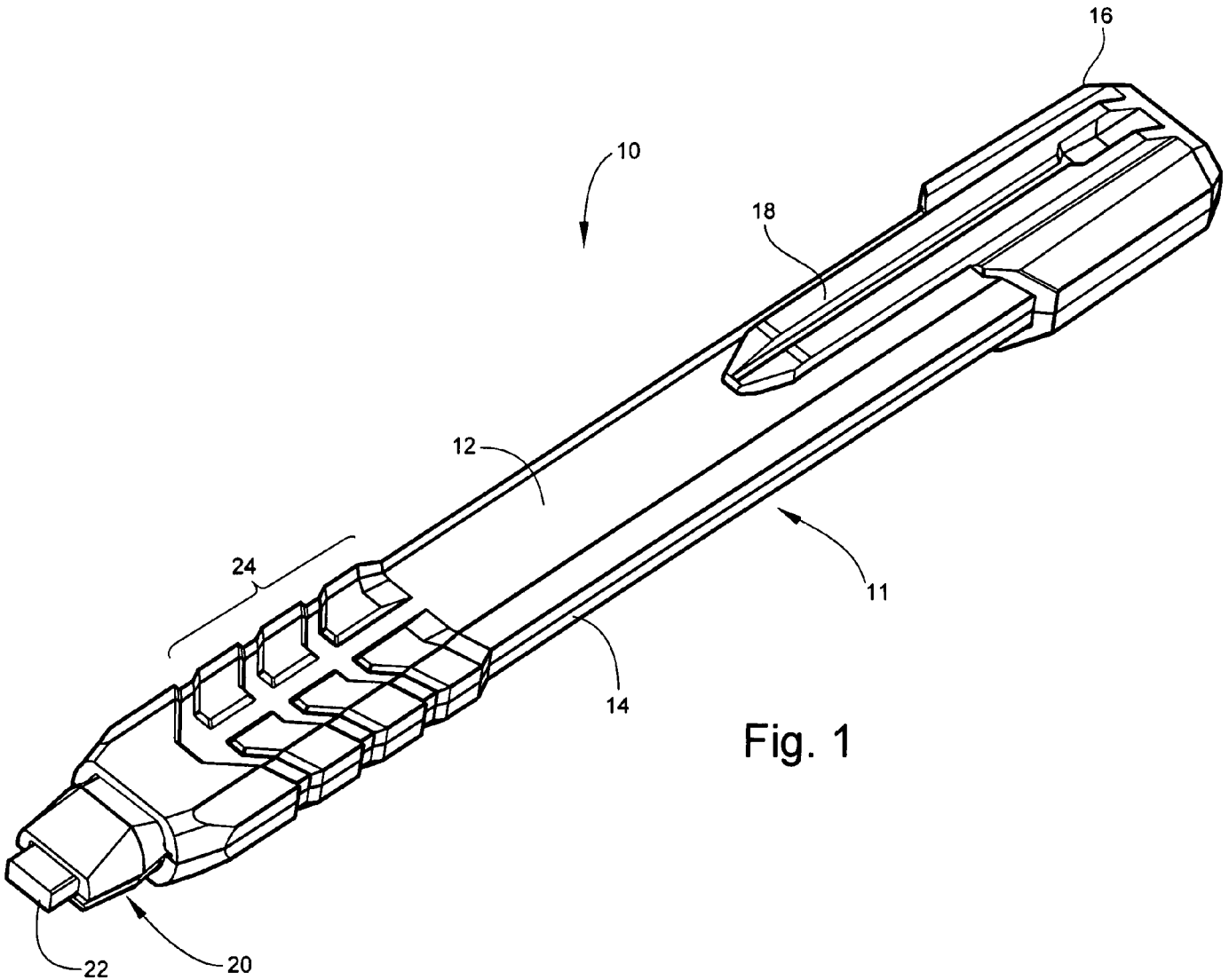
FIG. 1 is an isometric view of an embodiment of the present invention.

Referring to the drawings wherein like numerals refer to like elements, there is shown in FIG. 1 an embodiment of the mechanical pencil 10. Mechanical pencil 10 is preferably a carpenter's pencil, but is not so limited.

Figure 4:
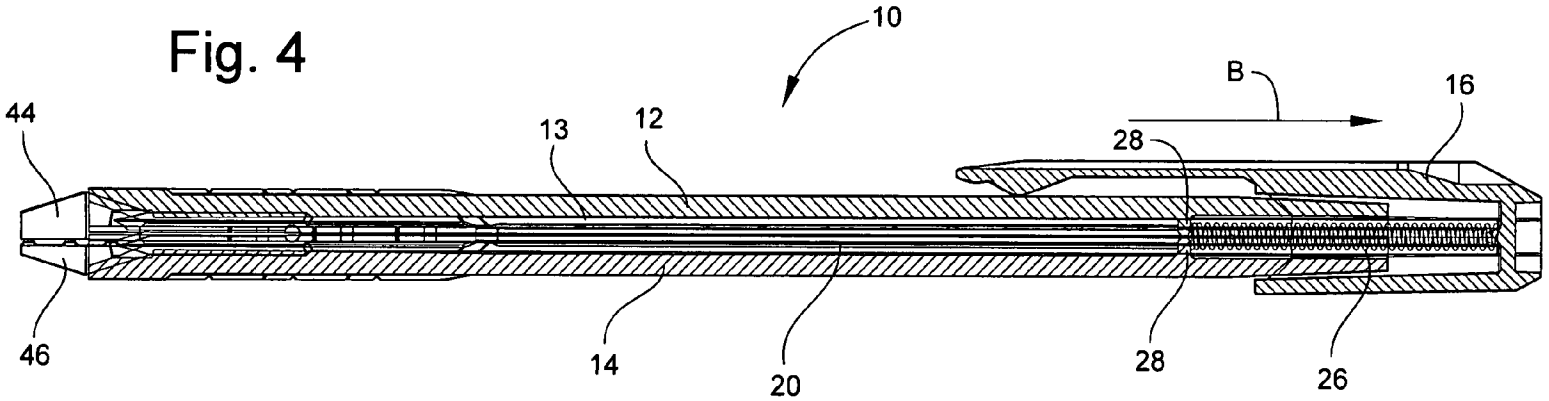
FIG. 4 is a sectional view of the embodiment shown in FIG. 1 with the lead holding mechanism recessed within the body.
Figure 5:
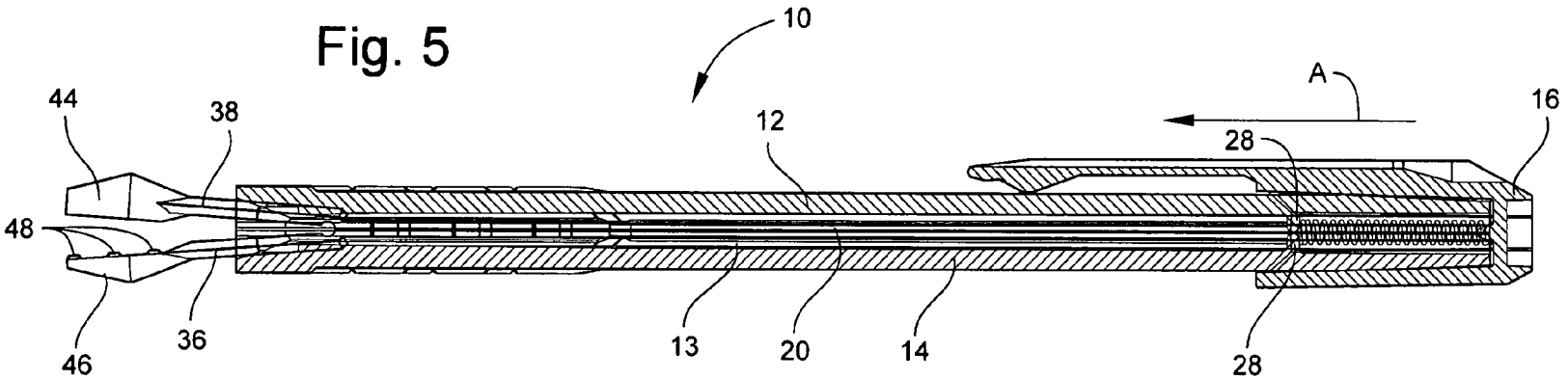
FIG. 5 is a sectional view of the embodiment shown in FIG. 1 with the lead holding mechanism advanced out of the body.

Pencil 10 generally comprises a body 11 having a first body component 12 and a second body component 14 which when joined together define a cavity 13 (best seen in FIGS. 4 and 5). A lead holding mechanism 20 (best seen in FIGS. 2, 4, and 5) is located within cavity 13. A cap 16 is located at one end of body 11. Cap 16 optionally may include a clip 18. Body 11 optionally may include grip surfaces 24 as a part of body components 12 and 14. Body components 12 and 14 and cap 16 may be made of a rigid thermoplastic, such as acrylonitrile-butadiene-styrene (ABS). Body components 12 and 14 are joined together, for example, by welding (thermal or ultrasonic), gluing, or mechanically.

Figure 2:
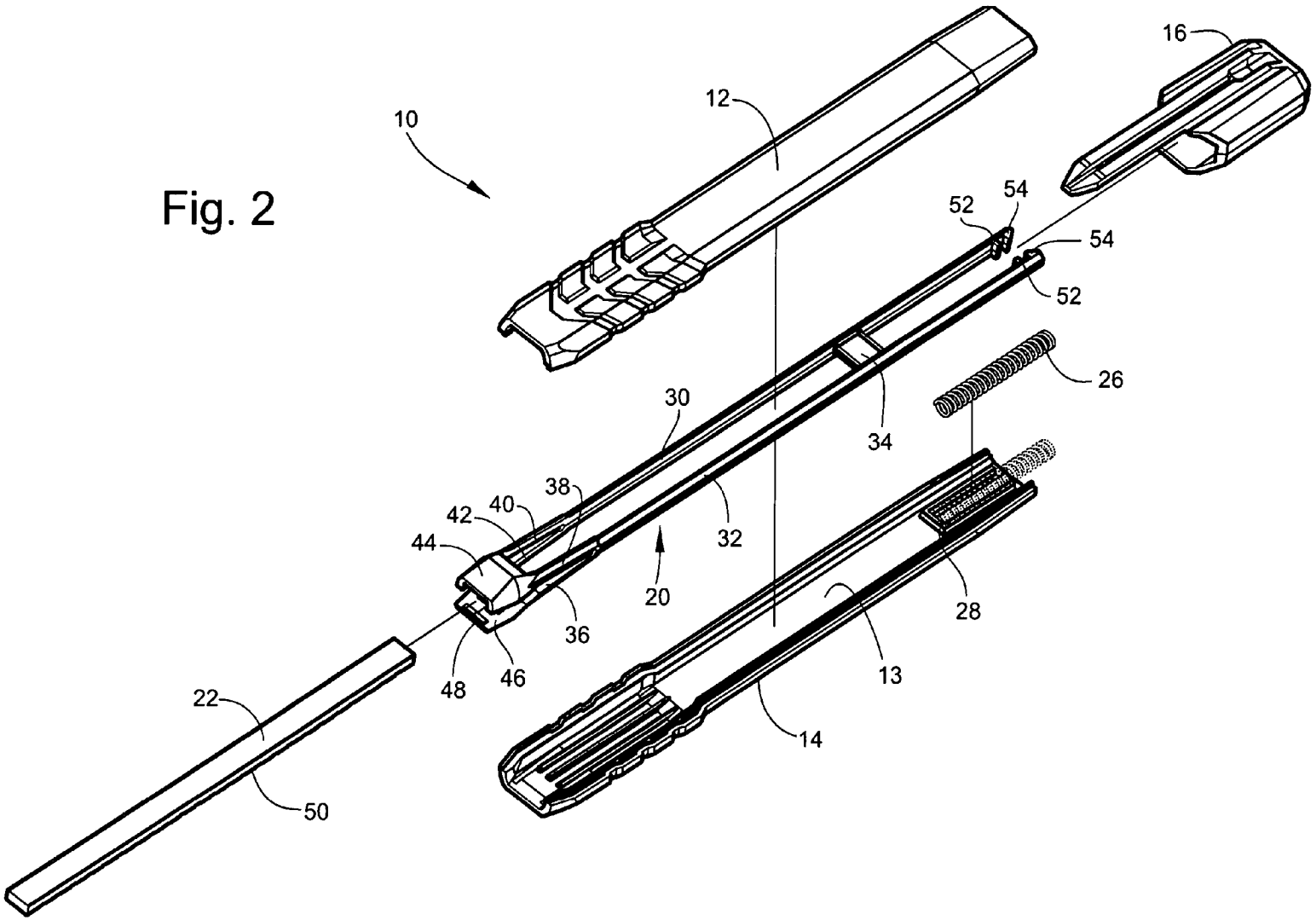
FIG. 2 is an exploded view of the embodiment shown in FIG. 1.

Referring to FIG. 2, lead holding mechanism 20 is seen in greater detail. Lead holding mechanism 20 generally comprises a pair of arms 30 and 32. Arms 30 and 32. generally parallel to one another and spaced apart. A bridge 34 joins arms 30 and 32. Bridge 34 may be located off the center of arms 30 and 32. Each arm 30 and 32 terminates with a pair of fingers 36/38 and 40/42. Fingers 36/38 are associated with arm 32. Fingers 40/42 are associated with arm 30. The fingers may be set at an acute angle to a line defined by their associated arms (as best seen in figures 2 and 5). The fingers may be integrally molded to arms and may be flexible, as will be more fully explained below. Catch 54 and stop 52 may be located on each arm 30 and 32 at the end of the arms opposite the fingers 36/38 and 40/42. Catch 54 and stop 52 may be adapted to engage cap 16 via slots (not shown) in cap 16 and to fasten lead holding mechanism 20 to cap 16, for reasons more fully explained below. Lead holding mechanism 20 may be made of a thermoplastic material that is flexible, such as polypropylene.

A spring 26 may be located within cavity 13. A spring rest 28 is formed within cavity 13 and is optionally an integrally molded part of body components 12 and 14. One end of spring 26 may sit on spring rest 28 and the other end may engage cap 16.

Figures 3A, 3B:
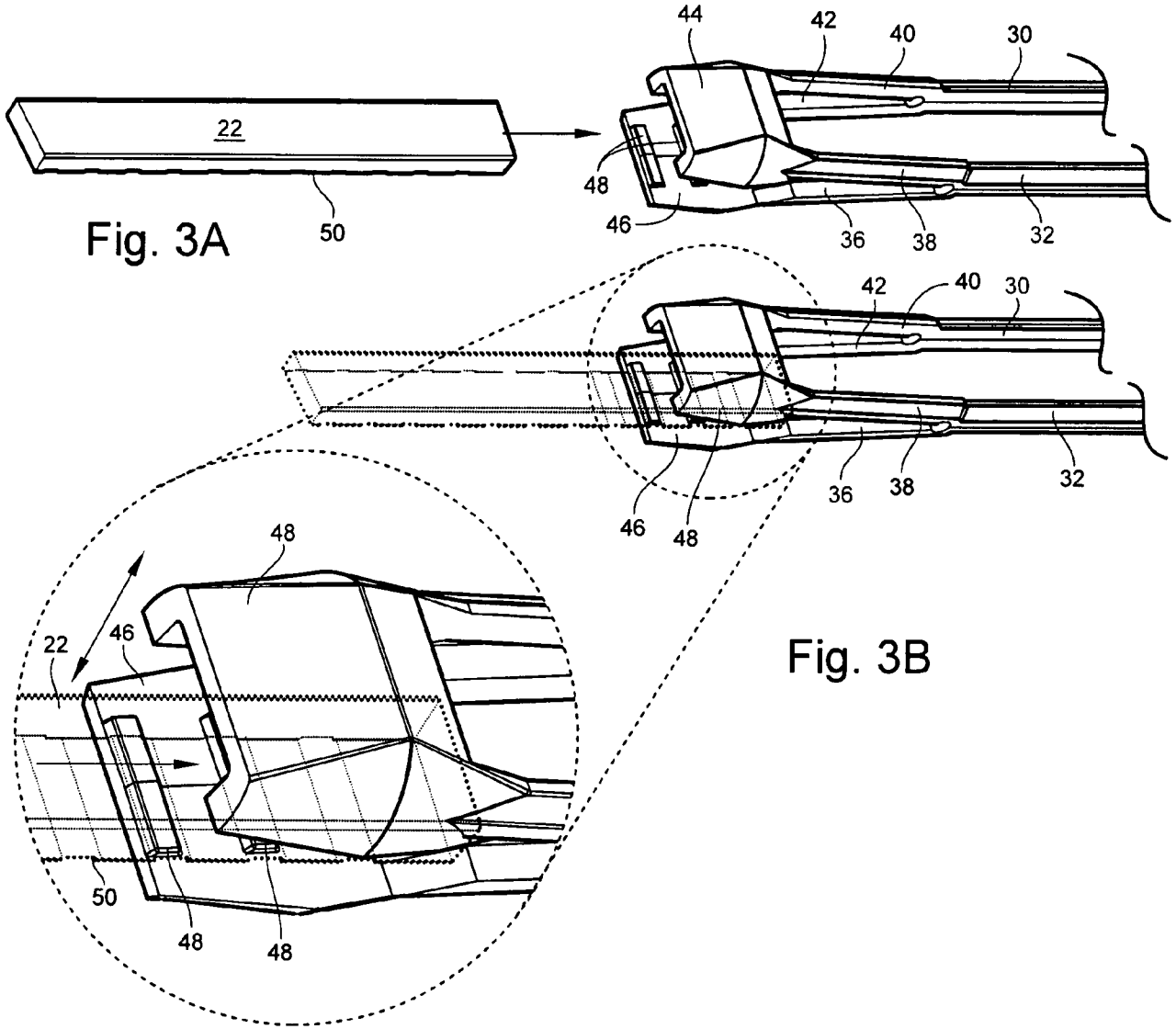
FIGS. 3A and 3B are detailed views of the embodiment shown in FIG. 1.

Referring to FIGS. 3A and 3B, clamp surfaces 44 and 46 are seen in greater detail. Clamp surface 44 optionally joins together fingers 38 and 40. Clamp surface 44, in another embodiment (not shown), may be divided (e.g., in half between arms 30, 32), so that fingers 38 and 40 are not joined. Clamp surface 44 generally has an inverted 'U' shaped cross section. The 'U' may be sized to receive and to hold, when clamp surfaces 44 and 46 are closed, a lead 22. Clamp surface 46 optionally joins fingers 36 and 42. Clamp surface 46, in another embodiment (not shown), may be divided (e.g., in half between arms 30, 32), so that fingers 38 and 40 are not joined. Clamp surface 46 has a generally planar surface, which when closed mates with the open side of clamp surface 44. Optionally, at least one tooth 48 may be located on the planar surface of clamp surface 46. The use of this tooth 48 will be discussed in greater detail below.

Again referring to FIGS. 3A and 3B, lead 22 is shown in greater detail. Lead 22 has a generally rectangular cross section. Optionally, corners of lead 22 may be rounded or beveled. One surface 50 of lead 22 has a plurality of grooves therein. The grooves are generally perpendicular to the longitudinal axis of the lead 22. The grooves are adapted to engaged the teeth 48 of clamp surface 46. When the grooves engage the teeth 48 and the clamp surfaces 44 and 46 are closed, the lead 22 is held in place between the clamp surfaces 44 and 46. Lead 22 may be made of any lead, chalk, crayon, or grease material as is well known in the art. Lead 22 in one embodiment may be a mixture of graphite and clay.

Referring to FIGS. 4 and 5, the operation of pencil 10 will be discussed. In FIG. 4, pencil 10 is shown with the lead holding mechanism 20 recessed within cavity 13. Note that the clamp surfaces 44 and 46 are closed which is caused by flexible fingers 36/38 and 40/42 being depressed by the inner walls of body components 12 and 14, as the holding mechanism is drawn into cavity 13. In the closed position, lead 22 is held firmly in place. Additionally, cap 16 is at its furthermost point of travel away from body 11 and spring 26 is relatively relaxed (i.e., the spring may be under a slight compressive load). In FIG. 5, cap 16 is depressed onto body 11 (Note arrow A), spring 26 is compressed, lead holding mechanism 20 is advanced out of cavity 13, and fingers 36/38 and 40/42 are allowed to open. In the opened position, lead 22 may be inserted into pencil 10 or advanced in or out of pencil 10. When cap 16 is released (Note arrow B), spring 26 returns to its relatively relaxed position and draws lead holding mechanism 20 into cavity 13 and fingers 36/38 and 40/42 close.

The present invention may be embodied in other forms without departing from the spirit and the essential attributes thereof, and, accordingly, reference should be made to the appended claims, rather than to the foregoing specification, as indicated the scope of the invention.

We claim:

1. A mechanical pencil comprising:

a body having a cavity, and a lead holding mechanism located in said cavity, said lead holding mechanism comprising:

a pair of arms;

each arm terminating with a pair of fingers;

said fingers being at an acute angle with a line defined by said arm;

said pair of arms being joined together by a bridge approximate to one of their ends and a first and second clamp surface at the other end;

said first clamp surface joining together the top finger of one of said arms with the top finger of the other said arm; and said second clamp surface joining together the bottom finger of one of said arms with the bottom finger of the other said arm;

said fingers closing together said clamp surfaces when said lead holding mechanism being recessed into said cavity and said fingers opening said clamp surfaces when said lead holding mechanism being advanced out of said cavity.

2. The pencil of claim 1 further comprising:

a spring engaging said lead holding mechanism for moving said mechanism from the advanced position to the recessed position.

3. The pencil of claim 2 further comprising a cap, said cap engaging said lead holding mechanism and said spring, and said cap being slidably mounted on said body.

4. The pencil of claim 3 wherein said cap being in a first position whereby said lead holding mechanism being in the recessed position and movable to a second position whereby said mechanism being in the advanced position.

5. The pencil of claim 2 further comprising a spring rest located within said cavity, said spring sitting on said rest.

6. The pencil of claim 1 wherein said arms of said lead holding mechanism consist of a pair of parallel spaced apart arms.

7. The pencil of claim 1 wherein one of said clamp surfaces comprises at least one tooth.

8. The pencil of claim 1 wherein said body and said lead holding mechanism being made of a synthetic material.

9. The pencil of claim 8 wherein said synthetic material being a thermoplastic material.

10. A kit comprising:

a mechanical pencil comprising:

a body having a cavity, and a lead holding mechanism located in said cavity, said lead holding mechanism comprising:

a pair of arms;

each arm terminating with a pair of fingers;

said fingers being at an acute angle with a line defined by said arm;

said pair of arms being joined together by a bridge approximate to one of their ends and a first and second clamp surface at the other end;

a first clamp surface joining together the top finger of one of said arms with the top finger of the other said arm; and a second clamp surface joining together the bottom finger of one of said arms with the bottom finger of the other said arm;

said fingers closing together said clamp surfaces when said lead holding mechanism being recessed into said cavity and said fingers opening said clamp surfaces when said lead holding mechanism being advanced out of said cavity; and a plurality of lead.

11. The pencil of claim 1 further comprising:

an elongated lead material having a generally rectangular cross section.

12. The pencil of claim 1 further comprising:

an elongated lead material having a generally rectangular cross section and having a surface with a plurality of grooves disposed generally perpendicuuiar to a longitudinal axis of said lead material.

* * * * *